US006665996B2

(12) United States Patent
Chang

(10) Patent No.: US 6,665,996 B2
(45) Date of Patent: Dec. 23, 2003

(54) RAISED FLOOR SYSTEM EQUIPPED WITH VIEW PANELS

(75) Inventor: Chi-Chen Chang, Taipei (TW)

(73) Assignee: Taiwan Semiconductor Manufacturing Co. Ltd, Hsin Chu (TW)

( * ) Notice: Subject to any disclaimer, the term of this patent is extended or adjusted under 35 U.S.C. 154(b) by 0 days.

(21) Appl. No.: 09/974,586

(22) Filed: Oct. 9, 2001

(65) Prior Publication Data

US 2003/0066258 A1 Apr. 10, 2003

(51) Int. Cl.[7] ..... E04C 2/38

(52) U.S. Cl. ..... 52/799.1; 52/308; 52/477; 52/791.1; 52/797.1

(58) Field of Search ..... 52/299, 384, 387, 52/308, 202, 203, 474, 477, 782.2, 788.1, 791.1, 796.1, 797.1, 799.1, 800.14, 204.61

(56) References Cited

U.S. PATENT DOCUMENTS 4,915,435 A * 4/1990 Levine ..... 296/74.1
4,999,964 A * 3/1991 Taylor ..... 52/477
5,715,636 A * 2/1998 Taylor ..... 52/308
6,413,618 B1 * 7/2002 Parker et al. ..... 428/195

FOREIGN PATENT DOCUMENTS

GB 2194975 A * 3/1988 ..... 52/126.2

* cited by examiner

*Primary Examiner*—Carl D. Friedman
*Assistant Examiner*—Naoko Slack
(74) *Attorney, Agent, or Firm*—Tung & Associates

(57) ABSTRACT

A view panel for a raised floor system is described which is constructed by an outer rigid frame, an upper plate of a tempered glass panel and a lower plate of an apertured steel panel for providing structural support of the view panel. The invention further describes a raised floor system that utilizes such view panels installed in floor panels in a semiconductor fabrication environment.

20 Claims, 4 Drawing Sheets

RAISED FLOOR SYSTEM EQUIPPED WITH VIEW PANELS

FIELD OF THE INVENTION

The present invention generally relates to a raised floor system for use in a semiconductor fabrication facility and more particularly, relates to a raised floor system that utilizes transparent view panels constructed by a tempered glass panel supported by an apertured steel panel to allow observation of utility gauges mounted under the raised floor system.

BACKGROUND OF THE INVENTION

In the recent development of semiconductor fabrication technology, the continuous miniaturization in device fabricated demands more stringent requirements in the fabrication environment and contamination control. When the feature size was in the 2 $\mu$m range, a cleanliness class of 100~1000 (i.e., the number of particles at sizes larger than 0.5 $\mu$m per cubic foot) was sufficient. However, when the feature size is reduced to 0.25 $\mu$m, a cleanliness class of 0.1 is required. It has been recognized that an inert mini-environment may be the solution to future fabrication technologies when the device size is reduced further. In order to eliminate micro-contamination and to reduce native oxide growth on silicon surfaces, the wafer processing and the loading/unloading procedures of a process tool must be enclosed in an extremely high cleanliness mini-environment that is constantly flushed with ultra-pure nitrogen that contains no oxygen and moisture.

Different approaches in modern clean room design have been pursued in recent years with the advent of the ULSI technology. One is the utilization of a tunnel concept in which a corridor separates the process area from the service area in order to achieve a higher level of air cleanliness. Under the concept, the majority of equipment maintenance functions are conducted in low-classified service areas, while the wafers are handled and processed in more costly high-classified process tunnels. For instance, in a process for 16 M and 64 M DRAM products, the requirement of contamination control in a process environment is so stringent that the control of the enclosure of the process environment for each process tool must be considered. This stringent requirement creates a new mini-environment concept which is shown in FIG. 1. Within the enclosure of the mini-environment of a process tool 10, an extremely high cleanliness class of 0.1 (i.e., the number of particles at sizes larger than 0.1 $\mu$m per cubic foot) is maintained, in contrast to a cleanliness class of 1000 for the overall production clean room area 12. In order to maintain the high cleanliness class inside the process tool 10, the loading and unloading sections 14 of the process tool must be handled automatically by an input/output device such as a SMIF (standard mechanical interfaces) apparatus.

FIG. 1 also shows a raised floor system 30. The raised floor system 30 is normally installed between 45 and 60 cm above the finished concrete waffle slab 32. The raised floor system 30 in general, covers the entire clean room production area. The grid 34 of the raised floor is based on a 60×60 cm system and is normally aligned with the center lines of the filter ceiling grid. Some of the floor tiles 36 are perforated for circulating the clean room air 38. The adjustment of the air pressure in the clean room and the balancing of air flow can be achieved by selecting floor tiles with proper perforations.

In the raised floor system 30 shown in FIG. 1, the floor tiles 36 should be static-dissipative and made of non-combustible material that is also chemical abrasion resistance. A frequently used material is vinyl which is impact resistant and meets the electrostatic discharge isolation resistance requirement for the clean room environment.

A detailed, cross-sectional view of a raised floor system 30 is shown in FIG. 2. The raised floor system 30 should be laterally stable in all directions with or without the presence of the floor tiles 36. This is achieved by anchoring the pedestals 40 into the concrete slab floor 32 and by the further use of stringers 42 and steel braces 44. The floor tiles are supported by the stringers 42 which are in turn supported at each corner by adjustable height pedestals 40. As shown in FIG. 2, the pedestals 40 are bolted to the finished concrete waffle slab 32. An insulation plate 46 placed on top of each pedestal 40 attenuates foot step sound and ensures electrical isolation. The steel braces 44 are used to further increase the rigidity of the raised floor system 30 and the pedestal support.

In recent years, for safety considerations such as for minimizing the risk from earthquake vibration in a highly stacked fab plant, screws or bolts are required at each corner of the raised floor panels 36. This makes it impossible to easily remove the floor panels by just using suction cups and lifting the panels. The structural reinforcement on the raised floor design therefore presents great difficulties in accessing utility panels that are frequently mounted under the raised floor. In order to access the utility panels, the screws or bolts at the corners of the floor panels must first be removed before a suction device can be used to lift up the floor panels. Furthermore, since the floor panels are normally fabricated of a vinyl plastic material that is opaque, the display on the utility panels, i.e., various gauges and dials, cannot be read or accessed without first removing the floor panels.

It is therefore an object of the present invention to provide a raised floor system for a semiconductor clean room facility that does not have the drawbacks or shortcomings of the conventional raised floor systems.

It is another object of the present invention to provide a raised floor system for a semiconductor clean room facility wherein the floor panels can be easily removed for accessing the utility panels.

It is a further object of the present invention to provide a raised floor system for a semiconductor clean room facility wherein the floor panels are not screwed into the stringers underneath.

It is another further object of the present invention to provide a raised floor system for a semiconductor clean room facility that is equipped with transparent panels supported by apertured steel panels.

It is still another object of the present invention to provide a raised floor system for a semiconductor clean room facility that is equipped with transparent panels such that the utility panels mounted thereunder can be observed.

It is yet another object of the present invention to provide a raised floor system for a semiconductor clean room facility that is equipped with removable floor panels each equipped with four view panels.

It is still another further object of the present invention to provide a raised floor system for a semiconductor clean room facility that is equipped with transparent tempered glass panels that are coated with a shatter-proof coating.

It is yet another further object of the present invention to provide a raised floor system for a semiconductor clean room facility that is equipped with transparent tempered glass panels mounted in a floor panel that are anti-electrostatic, highly rigid and scratch resistant.

SUMMARY OF THE INVENTION

In accordance with the present invention, a raised floor system for a semiconductor clean room facility can be provided which includes a first multiplicity of pedestals mounted to a floor at a lower end of the pedestals, a second multiplicity of stringers mounted to a top end of the first multiplicity of pedestals such that the stringers are parallel to the concrete floor, a third multiplicity of floor panels mounted to the second multiplicity of stringers, each of the floor panels includes at least one cavity therein adapted for receiving at least one view panel that is substantially transparent and is supported by at least one apertured steel panel in the third multiplicity of floor panels.

The raised floor system for a semiconductor clean room facility may further include a fourth multiplicity of braces for supporting the first multiplicity of pedestals. The at least one cavity in each of the third multiplicity of floor panels may further include a ridge portion along at least two sides in a rectangular shape cavity for supporting a view panel. The at least one cavity in each of the third multiplicity of floor panels may further include a ridge portion along four sides in a rectangular shaped cavity for supporting a view panel. The at least one cavity in each of the third multiplicity of floor panels may have a rectangular shape, or a square shape.

In the raised floor system for a semiconductor clean room facility, the at least one view panel may be formed of a transparent tempered glass panel supported by at least one apertured steel panel. The tempered glass panel may be coated on the backside with a shatter-proof coating. The at least one view panel may include four view panels of equal size. The at least one apertured steel panel may be fabricated of stainless steel. The at least one tempered glass panel may have a thickness of not less than 7 mm, or a thickness between about 7 mm and about 15 mm. The at least one apertured steel panel may have a thickness of at least 3 mm, or a thickness between about 3 mm and about 10 mm. The word "about" used in this writing indicates a range of value that is ±10% of the average value given.

The raised floor system for a clean room of a semiconductor fabrication facility may further include a plurality of utility panels mounted under the third multiplicity of floor panels which are visually inspectable through the at least one view panel. The at least one view panel has a top surface substantially flush with a top surface of the third multiplicity of floor panels when mounted in the third multiplicity of floor panels. The at least one view panel may further include two apertures therethrough adapted for opening the view panel by human fingers. The at least one panel insert may be fabricated of a material that is anti-electrostatic and abrasion resistant.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a view panel and a raised floor system for a semiconductor clean room facility that is equipped with removable floor panels each provided with at least one view panel. The transparent view panels enable the inspection of utility panels installed under the floor panels and the easy removal of the floor panels for accessing the various controls and gauges on the utility panels when necessary. The present invention raised floor system can be utilized in any factory environment that utilizes space under a raised floor for transporting gases or liquids used in the factory and for positioning of utility panels equipped with various control apparatus. However, the present invention raised floor system is particularly suited for use in a semiconductor clean room facility where most fluids are transported and their passages are controlled by control apparatus installed under the raised floor. The floor panels utilized in the present invention raised floor system may also be screwed or bolted to stringers that are supported by pedestals and braces.

Each of the floor panels may be provided with a plurality of cavities equipped with a ridge portion along an inner periphery of the cavities adapted for receiving view panels. The view panels may be fabricated by tempered glass panels supported by apertured steel panels. The tempered glass panels have high rigidity, high abrasion resistance, superior chemical resistance and good anti-electrostatic properties. When utility panels are positioned under the transparent view panels, the gauges and the dials on the utility panels can be easily inspected through the view panels. When adjustment to the dials becomes necessary, the view panels can be easily picked up by fingers through apertures provided in the view panels. The ridges provided in the cavities are positioned such that when the view panels are laid inside the cavities, the top surface of the tempered glass panels are flush with the top surfaces of the floor panels. There are no protrusions above the surface of the floor panels and thus no hindrance for walking or rolling of carts on the floor panels.

Figure 1:
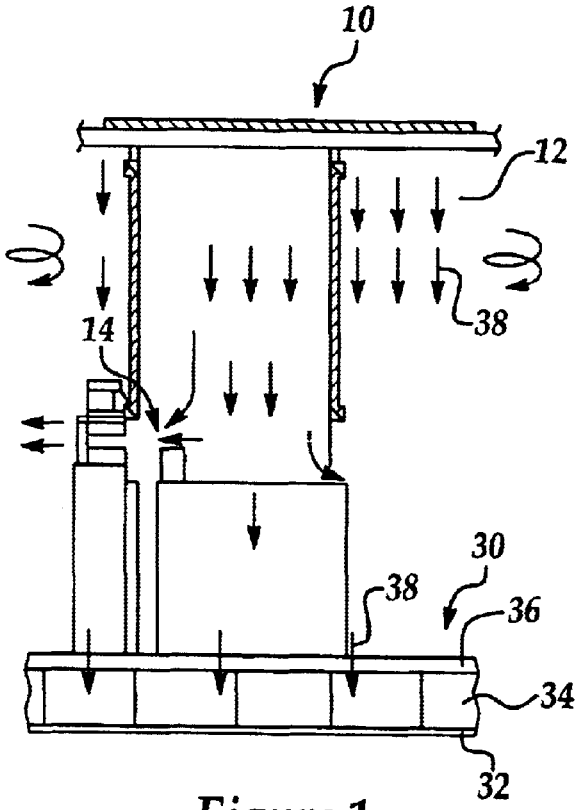
Figure 1 Prior Art
FIG. 1 is an illustration showing a conventional clean room set up on a raised floor system.
Figure 2:
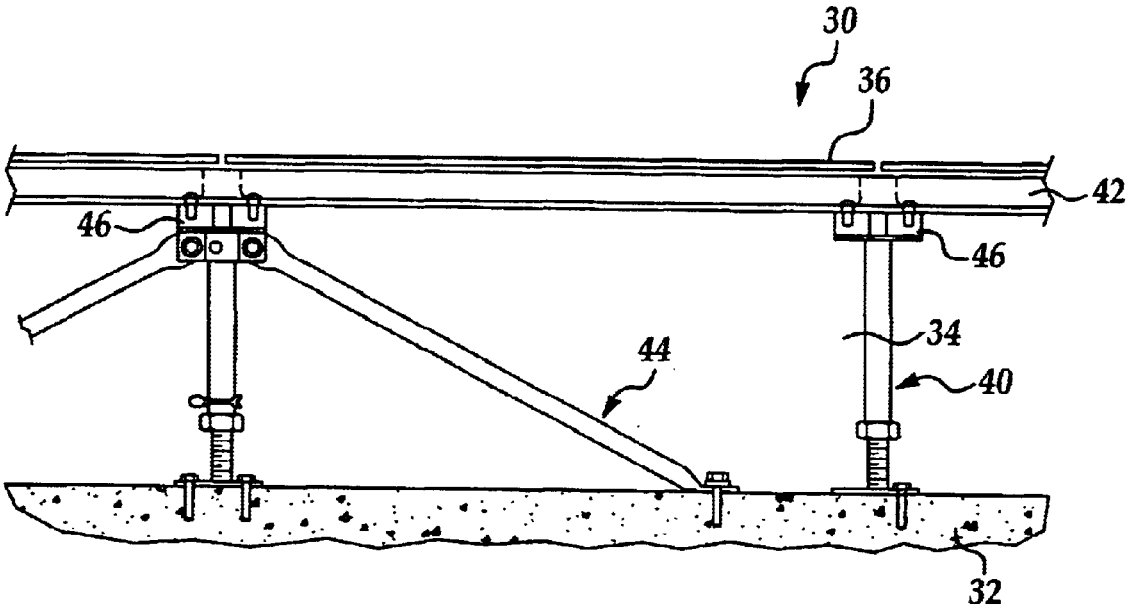
Figure 2 Prior Art
FIG. 2 is an enlarged, cross-sectional view of a conventional raised floor system incorporating braces and stringers.
Figure 3:
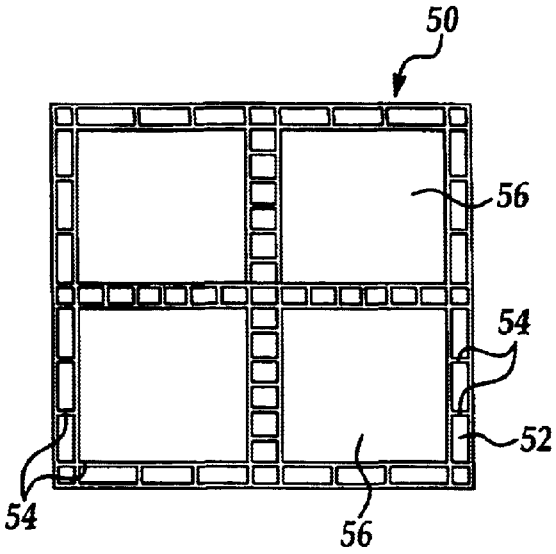
FIG. 3 is a plane view of the back side of a present invention floor panel showing four cavities for the view panel.

Referring initially to FIG. 3, wherein a present invention floor panel 50 provided with a plurality of cavities 56 is shown. In the specific configuration shown in FIG. 3, four equally sized square cavities are utilized. It should be noted that any other suitable numbers of cavities in any suitable shapes, i.e., square or rectangular, may be utilized in the present invention novel floor panels. As shown in FIG. 3, the back side 52 is shown with a multiplicity of rib structures 54 reinforcing the floor panel. The floor panel 50 is normally constructed of a light weight, high strength metal such as aluminum. Any other high strength material including those of reinforced plastics may also be used.

Figure 4:
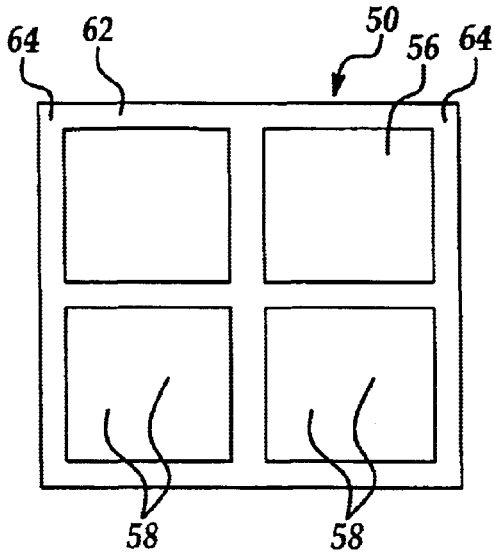
FIG. 4 is a plane view of the front side of a present invention floor panel showing ridges for holding the view panels in the cavities.

FIG. 4 illustrates a top view of the present invention floor panel 50. A ridge portion 58 is formed inside the cavities 56 along the inner peripheral edge of the cavities. The ridge portion 58 is used for supporting the view panels (not shown) installed therein. The ridge portion 58 should be designed such that it protrudes sufficiently outwardly from the inner periphery of the cavity to support the view panels when installed therein. The ridge portion 58 should further be designed with a depth measured from the top surface 62 of the floor panel 50 such that when the view panels(not shown) are positioned therein, the top surface of the view panels are flush with the top surface 62 of the floor panel 50. Mounting holes 64 for screws or bolts may also be provided at the four corners of the floor panel 50 for mounting to the stringers.

Figure 5A:
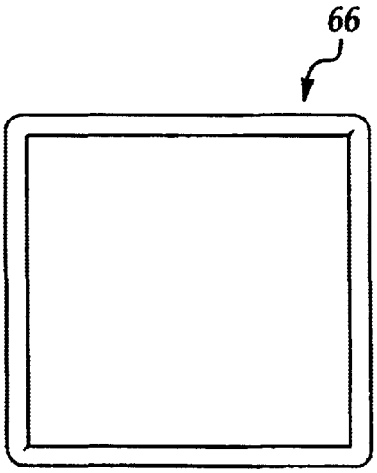
FIGS. 5A and 5B are a plane view and a perspective view, respectively, of an aluminum frame for the present invention view panel.
Figure 5B:
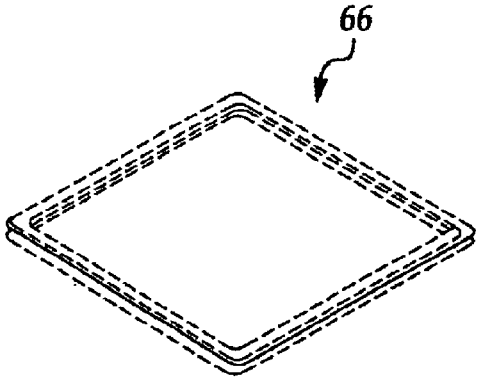
Figure 9A:
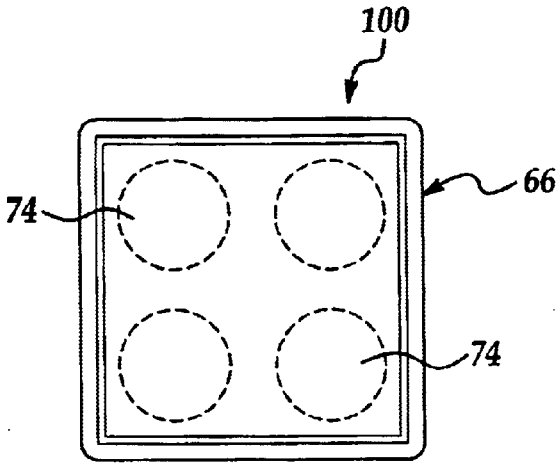
FIGS. 9A and 9B are a plane view and a perspective view, respectively, of the components of the view panel positioned together.

FIGS. 5A and 5B illustrate a plane view and a perspective view, respectively, of a rigid frame 66 utilized in the present invention view panel 100 shown in FIG. 9A. The rigid frame 66 may be suitably fabricated of aluminum, or of any material that has a rigidity of at least that of aluminum. The rigid frame 66 may have a "L" shaped cross-section such that the other components of the view panels, i.e., the glass panel 68, the rubber gasket 70 and the apertured steel panel 72 can be fitted therein by frictional engagement.

Figure 6A:
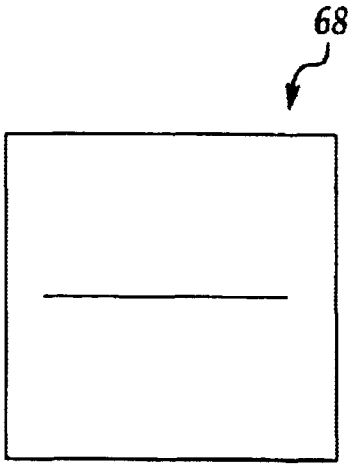
FIGS. 6A and 6B are a plane view and a perspective view of a tempered glass panel for the present invention view panel.
Figure 6B:
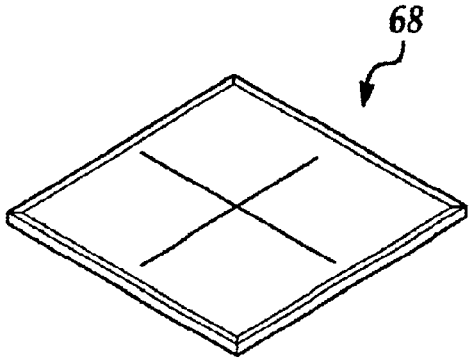
Figure 7A:
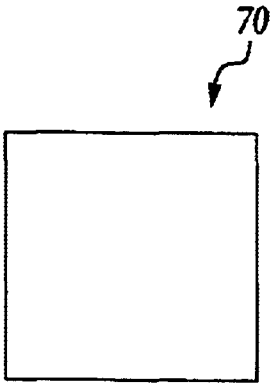
FIGS. 7A and 7B are a plane view and a perspective view, respectively, of a rubber gasket for the present invention view panel.
Figure 7B:
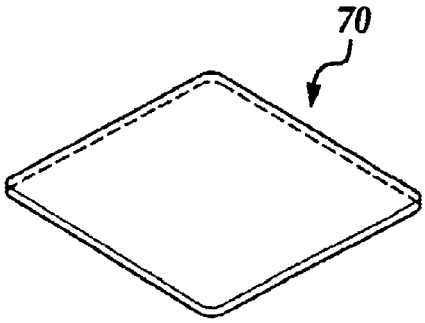

The glass panel 68 utilized in the present invention view panels 100 is shown in a plane view in FIG. 6A, and in a perspective view in FIG. 6B. The glass panel 68 should be fabricated of tempered glass that has significantly improved impact strength. The glass panel 68 may further be coated on a backside, i.e., the side that faces downwardly, a shatter-proof coating such that even when the glass panel 68 is broken, the broken pieces are held together for safety.

To absorb the impact of an operator walking on the tempered glass panel 68, or the rolling of a cart, it may be desirable to install a gasket 70 in between the glass panel 68 and the apertured steel panel 72 during the assembly of the components of the view panel 100. The gasket 70 can be fabricated of any suitable rubber material that can absorb impact and thus reduce the likelihood of breakage or cracking of the tempered glass panel 68.

Figure 8A:
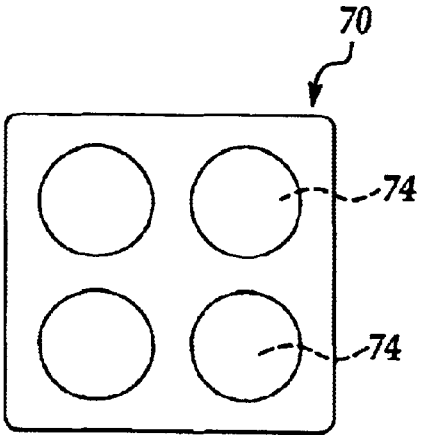
FIGS. 8A and 8B are a plane view and a perspective view, respectively, of an apertured steel panel for the present invention view panel.
Figure 8B:
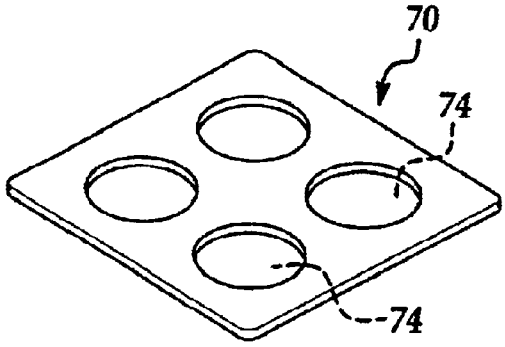

FIGS. 8A and 8B are a plane view and a perspective view, respectively, of an apertured steel panel 72 for used in the present invention view panel 100 for the support of the latter. While the tempered glass panel 68 may be provided in a thickness of at least 7 mm, and preferably in a thickness between about 7 mm and about 15 mm the apertured steel panel, preferably fabricated of stainless steel, should have a thickness smaller than the tempered glass panel 68, i.e., of about 3 mm, or in a range between about 3 mm and about 10 mm. In a preferred embodiment, the glass panel has a thickness of about 10 mm, while the apertured steel panel has a thickness of about 5 mm. The apertured steel panel 72 is further provided with at least one aperture 74, and preferably, four apertures as shown in FIGS. 8A and 8B, for easy observation of the utility panels mounted under the raised floor system. The diameter of the aperture 74 should be at least 2 cm and preferably at least 4 cm.

Figure 9B:
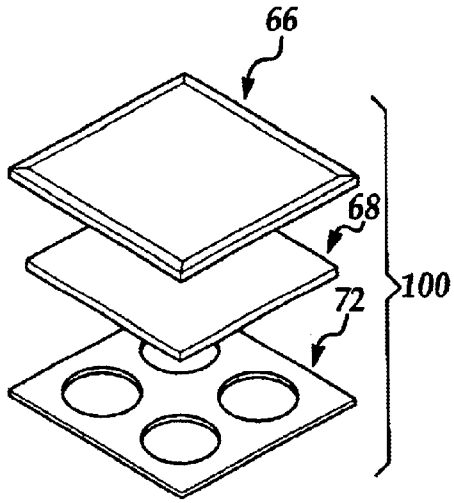

A plane view and a perspective view of the various components of the view panel 100 are shown in FIGS. 9A and 9B. It should be noted that the optional rubber gasket 70 is not shown in these figures. The components 66, 68 and 72 may be assembled together by frictional engagement, or by any other suitable mechanical means, i.e., clips (not shown) installed on the rigid frame 66.

Figure 10A:
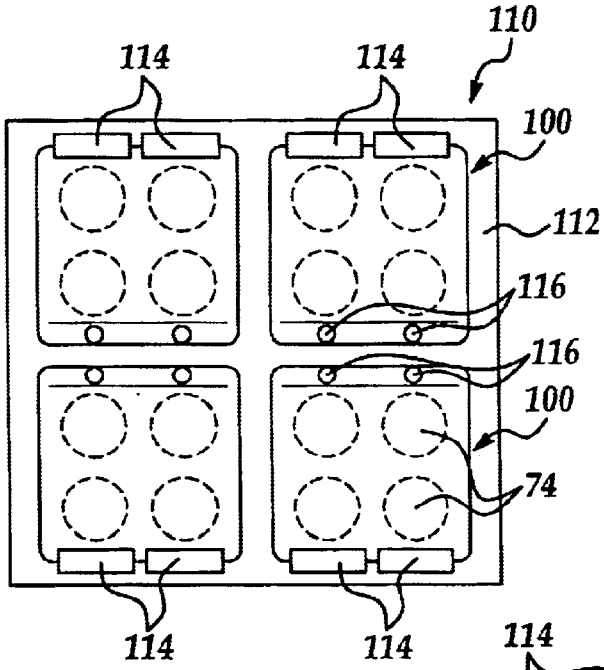
FIGS. 10A and 10B are a plane view and a perspective view, respectively, of the view panels assembled into a floor panel.
Figure 10B:
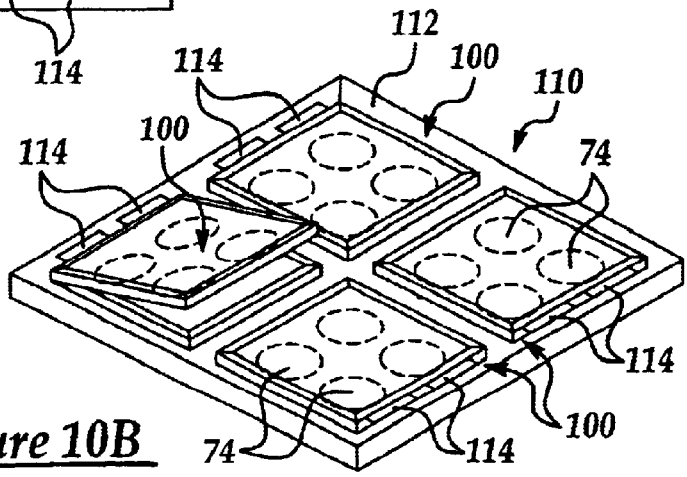

Each of the view panels 100 is then installed into the present invention floor panel 110, shown in FIGS. 10A and 10B. The frame 112 on the floor panel 110 is constructed similarly to that shown in FIG. 4, i.e., with a ridge portion similar to the ridge portion 58 of FIG. 4 for use as a stop for the view panels 100 in an installed position. The view panels 100 are each installed in the frame 112 by at least one hinge means 114.

In the preferred embodiment shown in FIG. 10A, two hinges 114 are used for installing each view panel 100 such that the view panel 100 can be pivotally opened, as shown in FIG. 10B. Also shown in FIG. 10A, apertures 116 are provided in the view panels 100 for accessing the latter by either a finger or a screw driver to open the view panel 100.

The present invention view panel 100 that is constructed by a tempered glass panel 68 and an apertured steel panel 72 in a rigid frame 66 has therefore been amply described in the above descriptions and in the appended drawings of FIGS. 3~10B.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A view panel for a raised floor system comprising:

an outer frame formed of a material having a rigidity at least equal to the rigidity of aluminum;

an upper plate surrounded by said outer frame in contact with a service environment formed of a substantially transparent material that has an abrasion resistance at least equal to that of a tempered glass; and A lower plate surrounded by said outer frame in contact with and supporting said upper plate formed of a metal that has a strength at least equal to that of stainless steel, said lower plate being provided with at least two apertures therethrough each having a diameter of at least 2 cm to allow visual observation through said upper plate.

2. A view panel for a raised floor system according to claim 1, wherein said outer frame being formed of aluminum.

3. A view panel for a raised floor system according to claim 1, wherein said upper plate being formed of a tempered glass.

4. A view panel for a raised floor system according to claim 1, wherein said upper plate being formed of a tempered glass coated on one surface with a shatter-proof coating.

5. A view panel for a raised floor system according to claim 1, wherein said upper plate being formed of a tempered glass having a thickness of at least 7 mm.

6. A view panel for a raised floor system according to claim 1, wherein said upper plate being formed of a tempered glass having a thickness between about 7 mm and about 15 mm.

7. A view panel for a raised floor system according to claim 1, wherein said lower plate being formed of stainless steel.

8. A view panel for a raised floor system according to claim 1, wherein said lower plate has a thickness of at least 3 mm.

9. A view panel for a raised floor system according to claim 1, wherein said lower plate has a thickness between about 3 mm and about 10 mm.

10. A view panel for a raised floor system according to claim 1, wherein said lower plate is provided with four apertures therethrough each having a diameter of at least 2 cm.

11. A view panel for a raised floor system according to claim 1, wherein said view panel is pivotally connected by a hinge means in a floor panel.

12. A raised floor system comprising:

a first multiplicity of pedestals mounted to a floor at a lower end, a second multiplicity of stringers mounted to an upper end of said first multiplicity of pedestals such that the stringers are parallel to the floor, a third multiplicity of floor panels mounted to said second multiplicity of stringers, each of said floor panels comprises at least one cavity therein adapted for receiving a view panel, and at least one view panel each constructed by a tempered glass panel and a rigid metal panel having at least one view port therein, said tempered glass panel being mated to said rigid metal panel in a face-to-face relationship for mounting in a rigid metal frame, said at least one view panel being mounted in said at least one cavity in said third multiplicity of floor panels.

13. A raised floor system according to claim 12, wherein said at least one view panel being pivotally mounted in said at least one cavity by hinge means.

14. A raised floor system according to claim 12, wherein said rigid metal panel has four view ports.

15. A raised floor system according to claim 12, wherein said rigid metal panel is formed of stainless steel.

16. A raised floor system according to claim 12, wherein said rigid metal frame is formed of a material which has a rigidity at least that of aluminum.

17. A raised floor system according to claim 12, wherein said tempered glass panel further comprises a shatter-proof coating on one surface.

18. A raised floor system according to claim 12, wherein said tempered glass panel has a thickness between about 7 mm and about 15 mm.

19. A raised floor system according to claim 12, wherein and rigid metal panel has a thickness between about 3 mm and about 10 mm.

20. A raised floor system according to claim 12, wherein said at least one view port has a diameter of at least 2 cm.

* * * * *